US008120563B2

(12) United States Patent
Takahashi

(10) Patent No.: US 8,120,563 B2
(45) Date of Patent: Feb. 21, 2012

(54) LCD DEVICE AND DRIVE CIRCUIT FOR DISCHARGING PIXELS IN A STEPWISE MANNER DURING A DISPLAY ON SEQUENCE

(75) Inventor: Kozo Takahashi, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 934 days.

(21) Appl. No.: 11/883,625

(22) PCT Filed: Feb. 8, 2006

(86) PCT No.: PCT/JP2006/002171

§ 371 (c)(1),
(2), (4) Date: Aug. 2, 2007

(87) PCT Pub. No.: WO2006/085555

PCT Pub. Date: Aug. 17, 2006

(65) Prior Publication Data

US 2008/0150932 A1 Jun. 26, 2008

(30) Foreign Application Priority Data

Feb. 10, 2005 (JP) ..... 2005-034567

(51) Int. Cl.
*G09G 3/36* (2006.01)

(52) U.S. Cl. ..... 345/94; 345/99

(58) Field of Classification Search ..... 345/94, 345/100, 214, 103, 99
See application file for complete search history.

(56) References Cited

U.S. PATENT DOCUMENTS

| | | | | |
|---|---|---|---|---|
| 6,069,620 | A | 5/2000 | Nakamura et al. | |
| 6,396,469 | B1 * | 5/2002 | Miwa et al. | 345/87 |
| 7,161,573 | B1 | 1/2007 | Takatori et al. | |
| 2002/0044117 | A1 | 4/2002 | Matsumura et al. | |
| 2003/0179221 | A1 * | 9/2003 | Nitta et al. | 345/690 |
| 2003/0218593 | A1 | 11/2003 | Inoue et al. | |

FOREIGN PATENT DOCUMENTS

| | | |
|---|---|---|
| JP | A-H02-272490 | 11/1990 |
| JP | 04-219016 | 8/1992 |
| JP | A-H06-27902 | 2/1994 |
| JP | A-H06-160806 | 6/1994 |
| JP | 07-064055 | 3/1995 |

(Continued)

*Primary Examiner* — Chanh Nguyen
*Assistant Examiner* — Ram Mistry
(74) *Attorney, Agent, or Firm* — Harness, Dickey & Pierce, P.L.C.

(57) ABSTRACT

A display ON sequence for preventing problems in a display at the starting time of a liquid crystal display device is prevented from having malfunctions, which might otherwise be caused in a scanning line drive circuit by applying a voltage to scanning signal lines. In the display ON sequence at the starting time of the liquid crystal display device of an active matrix type, all the scanning signal lines of a liquid crystal panel are brought into a selected state thereby to release the electric charges in the liquid crystal capacity and the auxiliary capacity in each pixel forming portion through data signal lines. After this, the scanning signal lines are stepwise brought into an unselected state by dividing them several times, before their sequential selections (or scans) for the display are started. Thus, the electric current to flow through the bulk of the scanning signal line drive circuit is made lower than that of the prior art, in which the scanning signal lines were simultaneously brought into the unselected state.

14 Claims, 12 Drawing Sheets

FOREIGN PATENT DOCUMENTS

| | | |
|---|---|---|
| JP | A-H07-333577 | 12/1995 |
| JP | 11-258573 | 9/1999 |
| JP | A-2001-272650 | 10/2001 |
| JP | 2002-072968 | 3/2002 |
| JP | A-2002-323875 | 11/2002 |

* cited by examiner

LCD DEVICE AND DRIVE CIRCUIT FOR DISCHARGING PIXELS IN A STEPWISE MANNER DURING A DISPLAY ON SEQUENCE

TECHNICAL FIELD

The present invention relates to drive circuits and drive methods for active matrix crystal display devices, and more specifically, to drive circuits and methods for discharging electric charges accumulated in pixel capacities in an active matrix liquid crystal display device when the device is started.

BACKGROUND ART

Conventional active matrix liquid crystal panels are constituted by two transparent substrates sandwiching a liquid crystal layer. One of the substrates is formed with a plurality of data signal lines (hereinafter may also called "source lines") and a plurality of scanning signal lines (hereinafter may also called "gate lines") crossing the data signal lines so as to provide a matrix of pixel formation portions each formed at one of the intersections. Each pixel formation portion includes a pixel electrode connected with one of the data signal lines that passes a corresponding intersection, via a TFT (Thin Film Transistor) which serves as a switching device. The TFT has its gate terminal connected to the scanning signal lines which passes the intersection. The other transparent substrate is formed with an electrode (hereinafter called "common electrode") which is common to all of the pixel electrodes. Liquid crystal display devices which employ a panel configured as the above are provided with a drive circuit for causing the liquid crystal panel to display images. The drive circuit includes a scanning signal line drive circuit (also called "gate driver") which applies scanning signals to the scanning signal lines for sequential selection of the scanning signal lines, and a data signal line drive circuit (also called "source driver") which applies data signals to the data signal lines for sequential writing of data to the pixel formation portions in the liquid crystal panel.

In such a liquid crystal display device, images to be displayed are formed by the plurality of pixel formation portions disposed in a matrix pattern. Each pixel formation portion has a circuit configuration as shown in FIG. 11(A), and includes: a capacity Clc (called "liquid crystal capacity") formed by a pixel electrode and a common electrode Ec which sandwich the liquid crystal layer; a capacity Cs (hereinafter called "supplementary capacity") formed by the pixel electrode and a supplementary electrode Es; and a TFT 10 which has its drain terminal connected with the pixel electrode. The TFT 10 has its source terminal connected with a data signal line DLk which passes through an intersection CPjk that corresponds to the pixel formation portion, and its gate terminal connected with a scanning signal line GLj that passes through the intersection CPjk. It should be noted that a pixel capacity for holding a voltage which represents the pixel value of the image to be displayed is formed by the liquid crystal capacity Clc and the supplementary capacity Cs.

In such a liquid crystal display device as the above, a data signal Dk is supplied from a data signal line DLk to the pixel electrode via the TFT 10 in each pixel formation portion, whereby a voltage which represents the value of the pixel that corresponds to the pixel electrode is applied between each pixel electrode and its common electrode Ec as well as between the pixel electrode and its supplementary electrode Es, to charge the liquid crystal capacity Clc and the supplementary capacity Cs. The liquid crystal layer changes its optical transmittance in accordance with the charge voltage, thereby displaying the image on the liquid crystal panel.

Now, there is a problem known with such a liquid crystal display device as the above: When the liquid crystal display device is started and before forming an image on the pixel formation portions by sequentially selecting the scanning signal lines (i.e. before starting display), electric potential in the common electrode Ec and the supplementary electrode Es rises to a certain extent to charge the liquid crystal capacity Clc or the supplementary capacity Cs in accordance with an electric potential difference between these two electrodes (FIG. 11(B)), resulting in an unintended black screen (in a normally-white screen) or a white screen (in a normally-black screen).

Conventional art attempts to solve this problem as follows: Right before starting display, an activation signal represented by an ON voltage is applied to all of the scanning signal lines, thereby turning on the TFTs and discharging the accumulated electric charges from the liquid crystal capacities Clc and the supplementary capacities Cs via the data signal lines DLk (FIG. 11(C)) (See Patent Document 1 through 4 for example).

FIG. 12 is a signal waveform chart which shows a sequence of operations (hereinafter called "Display-ON sequence") performed in the case as described above, from the time when a liquid crystal display device is turned on to the time when display is started. In this method, a Display-ON signal Son is generated as a signal which indicates a start of the Display-ON sequence, based on e.g. power-ON detection in the liquid crystal display devices. When the Display-ON signal Son becomes active (High level in the figure), an ON voltage (activation signal which turns ON the TFT) is applied in synchronization with the vertical synchronizing signal VSY to all of the scanning signal lines to select them (Time t1). Thereafter, an OFF voltage (deactivation signal which turns OFF the TFT) is applied to all of the scanning signal lines to deselect them all (Time t2) before beginning a normal scanning procedure. As described, according to the conventional art, an OFF voltage is applied to all of the scanning signal lines simultaneously when the scanning signal lines are switched from the Selected state to the Deselected state in the Display-ON sequence. The following is a list of documents which disclose techniques including the above that are related to the present invention:

[Patent Document 1] JP-A Hei 2-272490 Gazette
[Patent Document 2] JP-A 2001-272650 Gazette
[Patent Document 3] JP-A 2002-323875 Gazette
[Patent Document 4] JP-A 2003-295829 Gazette
[Patent Document 5] JP-A Hei 6-160806 Gazette

DISCLOSURE OF THE INVENTION

Problems to be Solved by the Invention

However, when all of the scanning signal lines are switched from the Selected state to the Deselected state simultaneously, a change from the high voltage (ON voltage) to the low voltage (OFF voltage) takes place in all of the scanning signal lines simultaneously, causing an electric current, which corresponds to a sum of capacities in all of the scanning signal lines, to pass through the bulk (silicon substrate) in the scanning signal line drive circuit. This causes a big electric potential change within the bulk, and in association with this, there is also caused a big power-source potential change in the scanning signal line drive circuit, which can lead to malfunction of the scanning signal line drive circuit.

Therefore, it is an object of the present invention to provide a drive circuit and a drive method capable of preventing malfunction in the scanning signal line drive circuit as described above caused by voltage application to the scanning signal lines in the Display-ON sequence performed when starting the liquid crystal display device.

Means for Solving the Problems

A first aspect of the present invention provides a drive circuit for an active matrix liquid crystal display device which includes: a plurality of data signal lines; a plurality of scanning signal lines crossing with the data signal lines; and a plurality of pixel formation portions disposed in a matrix pattern each corresponding to one of intersections made by the data signal lines and the scanning signal lines. Each pixel formation portion includes a capacity for taking and holding a voltage of a data signal line which passes through the corresponding intersection when the selection is made to the scanning signal line that passes through the intersection. The drive circuit applies to the data signal lines a plurality of data signals representing an image to be displayed while making sequential selection of the scanning signal lines for formation of the image to be displayed in the pixel formation portions.

The drive circuit includes:

a selection-making section for selecting the scanning signal lines upon reception of a signal indicating a commencement of display in the liquid crystal display device;

a discharging section for discharging electric charges accumulated at the capacities in the pixel formation portions via the data signal lines while the scanning signal lines are selected by the selection-making section; and a selection-canceling section for deselecting the scanning signal lines which have been selected by the selection-making section, in a stepwise manner after the discharge of the accumulated electric charges by the discharging section, before a commencement of sequential selection of the scanning signal lines.

A second aspect of the present invention provides the drive circuit according to the first aspect of the present invention, wherein the selection-canceling section deselects a plurality of scanning signal line groups created by grouping the scanning signal lines, one group at a time, in the stepwise manner.

A third aspect of the present invention provides the drive circuit according to the first aspect of the present invention, wherein the selection-canceling section deselects the scanning signal lines in a plurality of cycles at an interval of one horizontal scanning period for the display in the liquid crystal display device, in the stepwise manner.

A fourth aspect of the present invention provides the drive circuit according to the first aspect of the present invention, wherein the selection-canceling section deselects the scanning signal lines in a plurality of cycles at an interval of one vertical scanning period for the display in the liquid crystal display device, in the stepwise manner.

A fifth aspect of the present invention provides the drive circuit according to one of the first through the fourth aspects of the present invention, wherein the selection-making section selects the scanning signal lines in a stepwise manner.

A sixth aspect of the present invention provides the drive circuit according to the fifth aspect of the present invention, wherein the selection-making section selects a plurality of scanning signal line groups created by grouping the scanning signal lines, one group at a time, in the stepwise manner.

A seventh aspect of the present invention provides a liquid crystal display device which includes the drive circuit according to one of the first through the fourth aspects of the present invention.

An eighth aspect of the present invention provides a liquid crystal display device which includes the drive circuit according to the fifth aspect of the present invention.

A ninth aspect of the present invention provides a drive method for an active matrix liquid crystal display device which includes: a plurality of data signal lines; a plurality of scanning signal lines crossing with the data signal lines; and a plurality of pixel formation portions disposed in a matrix pattern each corresponding to one of intersections made by the data signal lines and the scanning signal lines. Each pixel formation portion includes a capacity for taking and holding a voltage of a data signal line which passes through the corresponding intersection when the selection is made to the scanning signal line that passes through the intersection. The drive method applies to the data signal lines a plurality of data signals representing an image to be displayed while making sequential selection of the scanning signal lines for formation of the image to be displayed in the pixel formation portions.

The drive method includes:

a selection-making step of selecting the scanning signal lines upon reception of a signal indicating a commencement of display in the liquid crystal display device;

a discharging step of discharging electric charges accumulated at the capacities in the pixel formation portions via the data signal lines while the scanning signal lines are selected in the selection-making step; and a selection-canceling step of deselecting the scanning signal lines which have been selected in the selection-making step, in a stepwise manner after the discharge of the accumulated electric charges in the discharging step, before a commencement of sequential selection of the scanning signal lines.

A tenth aspect of the present invention provides the drive method according to the ninth aspect of the present invention, wherein a plurality of scanning signal line groups created by grouping the scanning signal lines are deselected, one group at a time in a stepwise manner, in the selection-canceling step.

An eleventh aspect of the present invention provides the drive method according to the ninth or the tenth aspect of the present invention, wherein the scanning signal lines are selected in a stepwise manner, in the selection-making step.

A twelfth aspect of the present invention provides the drive method according to the eleventh aspect of the present invention, wherein a plurality of scanning signal line groups created by grouping the scanning signal lines are selected, one group at a time in a stepwise manner, in the selection-making step.

Advantages of the Invention

According to the first or the ninth aspect of the present invention, when starting display in a liquid crystal display device, all of the scanning signal lines are selected to release electric charges which are accumulated at capacities in each pixel formation portion, and thereafter, the scanning signal lines which have been in the Selected state are deselected in a stepwise manner. After deselecting all of the scanning signal lines in this way, sequential selection of the scanning signal lines for display, i.e. scanning, is started. Therefore, unlike in conventions where the scanning signal lines which have been in the Selected state are brought simultaneously to the Deselected state, the number of scanning signal lines in which the applied voltage changes simultaneously for the transfer from the Selected state to the Deselected state is remarkably smaller. This eliminates chances for an excessive current to pass through the bulk (silicon substrate) which constitutes the scanning signal line drive circuit, and therefore, there is reduced power source electric potential fluctuation caused by the current which flows through the bulk in the scanning signal line drive circuit when deselecting the scanning signal lines. As a result, it becomes possible to prevent malfunctions of the scanning signal line drive circuit caused by latch-ups for example, during a sequence of operations for electric potential discharge, i.e. the Display-ON sequence, performed for preventing display problems when starting the liquid crystal display device.

According to the second or the tenth aspect of the present invention, a plurality of scanning signal line groups created by grouping the scanning signal lines in the liquid crystal display device are deselected, one group at a time, in a stepwise manner; therefore, the selection-canceling section can be implemented with a simple configuration.

According to the third aspect of the present invention, the scanning signal lines are deselected in a stepwise manner, in a plurality of cycles at an interval of one horizontal scanning period, whereby it becomes possible to reduce power source electric potential fluctuation caused by the current which flows through the bulk in the scanning signal line drive circuit when deselecting the scanning signal lines, and to prevent malfunctions of the scanning signal line drive circuit caused by latch-ups for example during the Display-ON sequence.

According to the fourth aspect of the present invention, the scanning signal lines are deselected in a stepwise manner, in a plurality of cycles at an interval of one vertical scanning period, whereby it becomes possible to reduce power source electric potential fluctuation caused by the current which flows through the bulk in the scanning signal line drive circuit when deselecting the scanning signal lines, and to prevent malfunctions of the scanning signal line drive circuit caused by latch-ups for example during the Display-ON sequence. It should be noted here that since a vertical scanning period is used as an interval for the stepwise deselection of the scanning signal lines, the Display-ON sequence will take a longer time than in a case where a horizontal scanning period is used as the interval for a stepwise deselection of the scanning signal lines; however, the selection-canceling section can be implemented more easily.

According to the fifth or the eleventh aspect of the present invention, the scanning signal lines in the liquid crystal display device is selected in a stepwise manner upon reception of a signal indicating a commencement of display in the liquid crystal display device; therefore, there is reduced power source electric potential fluctuation caused by the current which flows through the bulk in the scanning signal line drive circuit when selecting the scanning signal lines. Thus, it becomes possible to prevent malfunctions of the scanning signal line drive circuit caused by latch-ups for example, during the Display-ON sequence more reliably.

According to the sixth or the twelfth aspect of the present invention, a plurality of scanning signal line groups created by grouping the scanning signal lines are selected, one group at a time in a stepwise manner; therefore, the selection-making section for making the scanning signal lines in a plurality of cycles can be implemented with a simple configuration.

LEGEND

Figure 1:
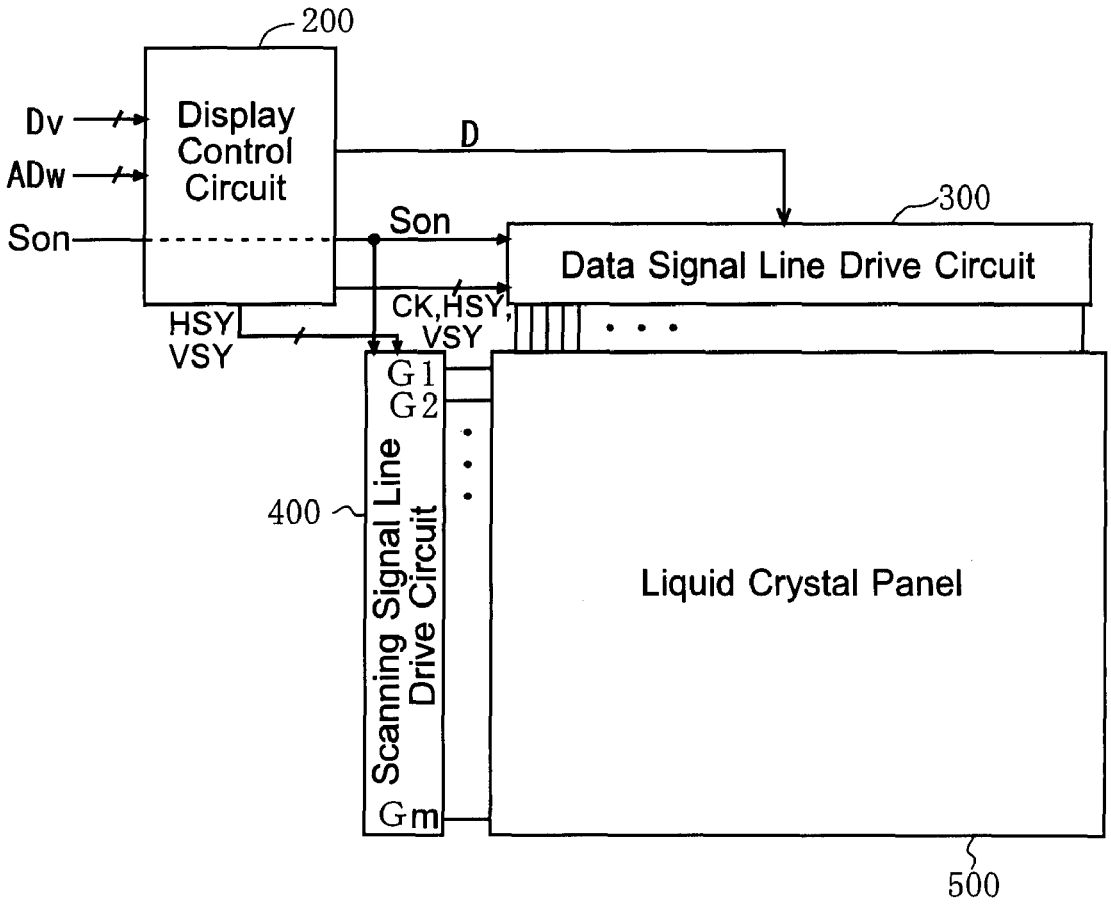
FIG. 1 is a block diagram showing a configuration of a liquid crystal display device according to a first embodiment of the present invention.

10 . . . TFT (thin-film transistor)
33, 33*b* . . . Reset signal generation circuits
33*c* . . . Set signal generation circuit
34, 34*b* . . . AND gates
35 . . . Shift register
38 . . . AND gate
200 . . . Display control circuit
300 . . . Data signal line drive circuit
400 . . . Scanning signal line drive circuit
500 . . . Liquid crystal panel
Clc . . . Liquid crystal capacity
Cs . . . Supplementary capacity
Ep . . . Pixel electrode
Ec . . . Common electrode
Es . . . Supplementary electrode
DL1-DLn . . . Data signal lines
GL1-GLm . . . Scanning signal lines
Px . . . Pixel formation portion
HSY . . . Horizontal synchronizing signal
VSY . . . Vertical synchronizing signal
D . . . Digital image signal
D1-Dm . . . Data signals
GCK . . . Clock signal (of the scanning signal line drive circuit)
GSP . . . Start pulse signal (of the scanning signal line drive circuit)
Gon . . . Selection control signal
Goff . . . Deselection control signal
G1-Gm . . . Scanning signals
Ga1-Ga4 . . . First through fourth area scanning signals
R1-R4 . . . Reset signals S1-S4 . . . Set signals
Son . . . Display-ON signal
VGL . . . Gate OFF voltage
VGH . . . Gate ON voltage

BEST MODE FOR CARRYING OUT THE INVENTION

Hereinafter, embodiments of the present invention will be described with reference to the attached drawings.

1. First Embodiment

<1.1 Overall Configuration and Operation>

FIG. 1 is a block diagram which shows a configuration of a liquid crystal display device according to a first embodiment of the present invention. The liquid crystal display device includes: a display control circuit 200; a drive circuit constituted by a data signal line drive circuit 300 and a scanning signal line drive circuit 400; and an active matrix liquid crystal panel 500.

The liquid crystal panel 500, which serves as a display section in the liquid crystal display device, includes a plurality of scanning signal lines, a plurality of data signal lines crossing each of the scanning signal lines, and a plurality of pixel formation portions each provided correspondingly to one of the intersections made by the scanning signal lines and the data signal lines. Each of the scanning signal lines corresponds to one horizontal scan of an image data Dv received from e.g. an external CPU or other control section of an electronic appliance which uses the liquid crystal display device. Each pixel formation portion has a configuration which is essentially the same as in conventional active matrix liquid crystal panels.

In the present embodiment, (narrowly defined) image data which represent an image to be displayed on the liquid crystal panel 500, and data (such as data indicating a display clock frequency) which determine timing, etc. of the display operation (hereinafter called "display control data") are sent from outside of the liquid crystal display device according to the present embodiment, e.g. from an external CPU or other control section (hereinafter called "external CPU, etc.") of an electronic appliance which uses the liquid crystal display devices to the display control circuit 200 (hereinafter, these data Dv sent from the outside will be called "widely defined image data"). In other words, (narrowly defined) image data and display control data which constitute widely defined image data Dv as well as address signals ADw are supplied to the display control circuit 200 and written to a display memory and register in the display control circuit 200 by the external CPU, etc.

Based on the display control data written to the register, the display control circuit 200 generates a display clock signal CK, a horizontal synchronizing signal HSY, a vertical synchronizing signal VSY and so on. Further, the display control circuit 200 reads the (narrowly defined) image data, which were written into the display memory by the external CPU, etc., from the display memory, and outputs the data as a digital image signal D. Of these different signals thus generated by the display control circuit 200, the clock signal CK is supplied to the data signal line drive circuit 300, the horizontal synchronizing signal HSY and the vertical synchronizing signal VSY are supplied to the data signal line drive circuit 300 and the scanning signal line drive circuit 400, and the digital image signal D is supplied to the data signal line drive circuit 300. The display control circuit 200 also receives from the external CPU, etc. a Display-ON signal Son as an instruction signal for starting display in the liquid crystal display device, and supplies the Display-ON signal Son to the data signal line drive circuit 300 and the scanning signal line drive circuit 400. It should be noted here that an instruction signal for starting display in the liquid crystal display device need not necessarily be received from outside of the liquid crystal display device: Instead, a signal for starting display may be generated in the display control circuit 200 based on e.g. power-ON detection in the liquid crystal display device, and the generated signal may serve as the Display-ON signal Son to be supplied to the data signal line drive circuit 300 and the scanning signal line drive circuit 400.

As described, the data signal line drive circuit 300 is supplied with data which represent an image to be displayed in the liquid crystal panel 500, serially for each pixel unit, in the form of the digital image signal D, and at the same time, supplied with such timing indication signals as the clock signal CK, the horizontal synchronizing signal HSY and the vertical synchronizing signal VSY. Based on these signals D, CK, HSY and VSY, the data signal line drive circuit 300 generates an image signal (hereinafter called "data signal") for driving the liquid crystal panel 500, and applies this signal to each of the data signal lines in the liquid crystal panel 500. In the Display-ON sequence, the data signal line drive circuit 300 operates as a discharging section for discharging an accumulated electric charge from each pixel capacity based on the Display-ON signal Son as will be described later.

The scanning signal line drive circuit 400 generates, based on the horizontal synchronizing signal HSY and the vertical synchronizing signal VSY, a scanning signal (G1, G2, . . . ) to be applied to a corresponding one of the scanning signal lines for sequential selection of a scanning signal line in the liquid crystal panel 500 per each horizontal scanning period; and repeats a cycle of application of the active scanning signal to each scanning signal line for sequential selection of all the scanning signal lines in each vertical scanning period (one frame period). As will be described later, before beginning this sequential selection of the scanning signal lines, i.e. during the Display-ON sequence before starting scanning, the scanning signal line drive circuit 400 performs a round of selecting and deselecting scanning signal lines based on the Display-ON signal Son, for discharging the accumulated electric charge from each pixel capacity.

As described above, in the liquid crystal panel 500, the data signal lines are given data signals based on the digital image signal D by the data signal line drive circuit 300 whereas the scanning signal lines are given scanning signals by the scanning signal line drive circuit 400. Thus, the liquid crystal panel 500 displays an image represented by the image data D received from the external CPU, etc.

Figure 2:
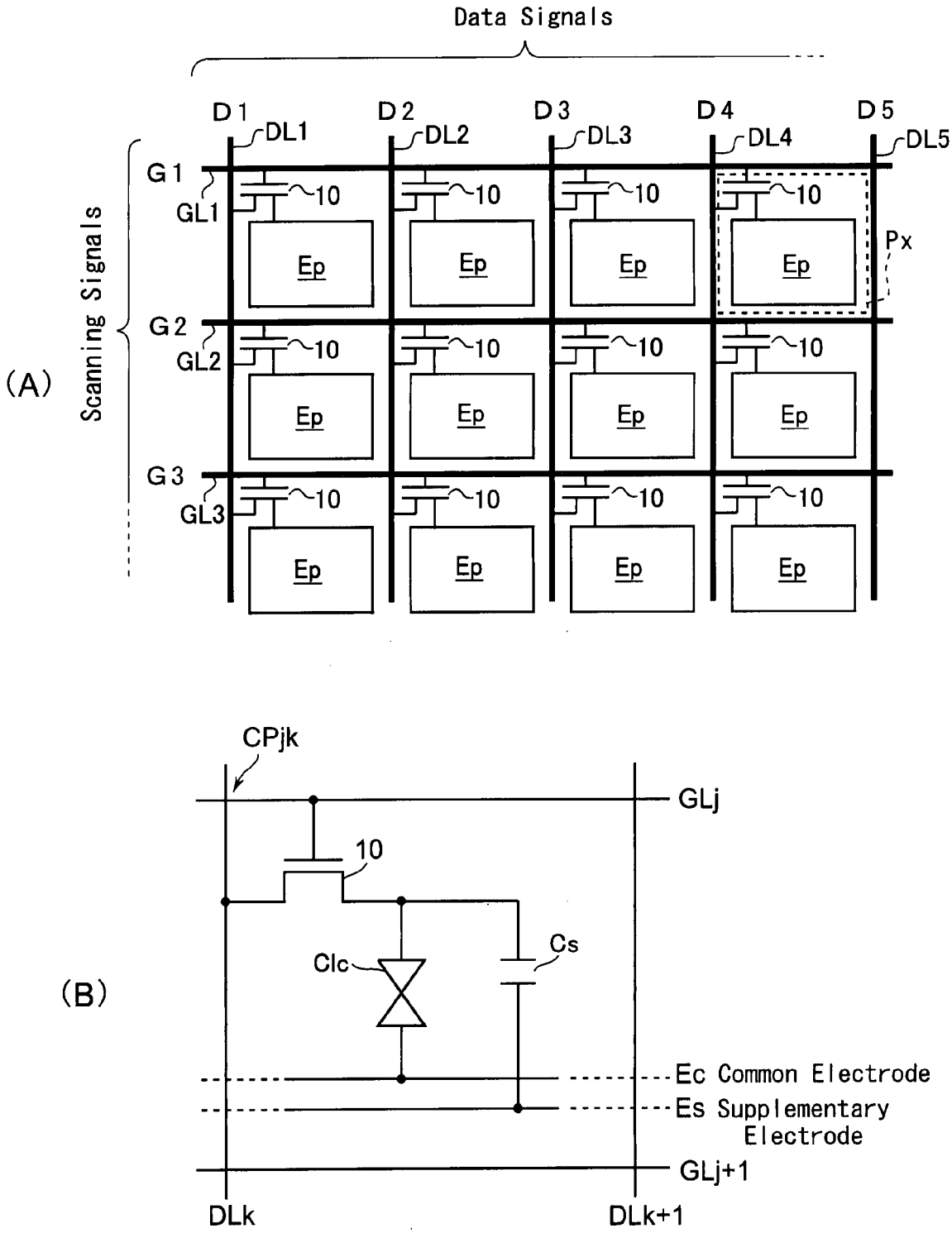
FIG. 2(A) is a conceptual diagram showing a configuration of the liquid crystal display panel according to the first embodiment.
FIG. 2(B) is a circuit diagram showing an equivalent circuit of a part of the liquid crystal display panel (a portion representing a pixel).

FIG. 2(A) is a conceptual diagram showing a configuration of the liquid crystal panel 500 in the liquid crystal display device according to the present embodiment. FIG. 2(B) is a circuit diagram showing an equivalent circuit of a part (a portion representing a pixel) of the liquid crystal panel 500. In these figures, alphanumeric symbols D1, D2, D3, . . . each indicate data signals which are applied to data signal lines DL1, DL2, DL3, . . . respectively. Also, the symbols G1, G2, G3, . . . each indicate scanning signals which are applied to the scanning signal lines GL1, GL2, GL3, . . . respectively.

The liquid crystal panel 500 has: a plurality (n) of data signal lines DL1-DLn each connected with one of a plurality (n) of output terminals in the data signal line drive circuit 300; and a plurality (m) of scanning signal lines GL1-GLm each connected with one of a plurality (m) of output terminals in the scanning signal line drive circuit 400. The data signal lines DL1-DLn and the scanning signal lines GL1-GLm are disposed in a grid pattern so that each of the data signal lines DLk (k=1, 2, . . . , n) crosses each of the scanning signal lines GLj (j=1, 2, . . . , m). Correspondingly to respective intersections made by the data signal lines DL1-DLn and the scanning signal lines GL1-GLm, there are provided a plurality (m times n) of pixel formation portions Px in a matrix pattern. As shown in FIG. 2(B), each pixel formation portion Px has a conventional configuration, including: a liquid crystal capacity Clc formed by a pixel electrode Ep and a common electrode Ec sandwiching the liquid crystal layer; a supplementary capacity Cs formed by the pixel electrode Ep and the supplementary electrode Es; and a TFT 10 having its drain terminal connected with the pixel electrode Ep. The TFT 10 has its source terminal connected with a data signal line DLk which passes through an intersection CPjk that corresponds to the pixel formation portion Px, and its gate terminal connected with a scanning signal line GLj which passes through the intersection CPjk. Therefore, each of the pixel formation portions Px picks a value of a data signal Dk, i.e. a voltage which represents the pixel value, on the data signal line DLk which passes through the corresponding intersection CPjk when selection is made to the scanning signal line GLj that passes through the corresponding intersection CPjk (i.e. when the scanning signal Gj is active), and holds the voltage in the pixel capacity constituted by the liquid crystal capacity Clc and the supplementary capacity Cs.

<1.2 Display-ON Sequence>

Figure 3:
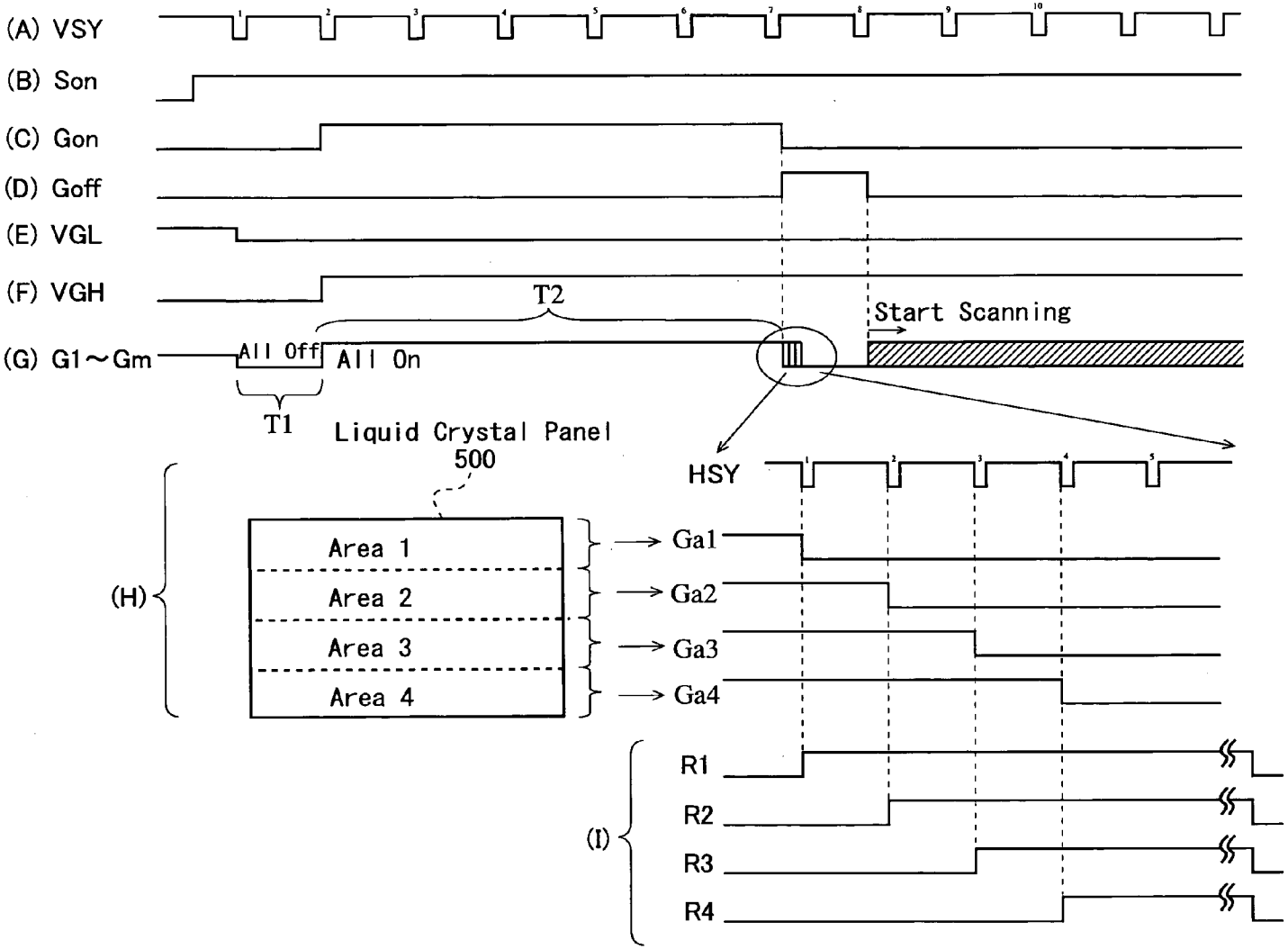
FIG. 3 shows signal waveform charts (A through I) for describing an example of Display-ON sequence according to the first embodiment.

Hereinafter, reference will be made to FIG. 3 to describe a sequence of operations, i.e. a Display-ON sequence, performed from the time when the liquid crystal display device according to the present embodiment is started to the time when display is started by sequentially selecting the scanning signal lines GL1-GLm. FIG. 3 shows waveform charts of a vertical synchronizing signal VSY, a gate OFF voltage VGL, a gate ON voltage VGH, a scanning signals G1-Gm, etc. (including a first-area through a fourth-area scanning signals Ga1-Ga4 to be described later), right after the liquid crystal display device according to the present invention is started. The gate OFF voltage VGL is a deactivation scanning signal, or a voltage applied to those scanning signal lines which are to be deselected. The gate ON voltage VGH is an activation scanning signal, or a voltage applied to those scanning signal lines which are to be selected (The same applies to other embodiments and variations to be described later).

In the present embodiment, the Display-ON sequence is performed as conventionally, i.e. by changes in various signals in synchronization with the vertical synchronizing signal VSY, after a Display-ON signal Son becomes active (HIGH level) to indicate a beginning of the Display-ON sequence. Specifically, when the vertical synchronizing signal VSY becomes active (LOW level) for the first time since the Display-ON signal Son has become active, the gate OFF voltage VGL assumes its normal voltage (a predetermined low voltage which turns OFF the TFT 10). Thereafter, at a time point when one frame period T1 has passed, (at a time point when the vertical synchronizing signal becomes active the next time), the gate ON voltage VGH assumes its normal voltage (a predetermined high voltage which turns ON the TFT 10). During this process, in order to eliminate an incidental unintended black screen (in a normally-white screen) or a white screen (in a normally-black screen), all of the scanning signals G1-Gm assume the gate ON voltage (active), to select all of the scanning signal lines GL1-GLm. When all of the scanning signal lines GL1-GLm are in the Selected state in the Display-ON sequence as described, the TFT 10 in each pixel formation portion Px is in the ON state, and as conventionally, electric charges accumulated at the liquid crystal capacity Clc and the supplementary capacity Cs in each pixel formation portion Px are discharged via the data signal line DLk. Therefore, the data signal line drive circuit 300 during this process functions as a discharging section by driving each of the data signal lines DL1-DLn so that each of the data signal lines DL1-DLn will have the same electric potential as its common electrode Ec and the supplementary electrode Es.

Then, after a lapse of time period T2 which is equivalent to a several frame periods, all of the scanning signals G1-Gm assume the gate OFF voltage (deactive), to deselect all of the scanning signal lines GL1-GLm. Unlike the convention where all of the scanning signal lines are deselected simultaneously, the scanning signal lines GL1-GLm are deselected in four cycles in a stepwise manner as will be described here below:

In the present embodiment, the liquid crystal panel 500 is divided into four areas, or area 1 through area 4, as shown in FIG. 3(H). Based on this zoning, four cycles of deselection operation are performed at an interval of one horizontal scanning period to deselect the scanning signal lines GL1 through GLm in gradual steps. Specifically, scanning signals G1 through Gma applied to those scanning signal lines included in the area 1 will be collectively called "a first-area scanning signal" and indicated by a symbol "Ga1". Scanning signals Gma+1 through Gmb applied to those scanning signal lines included in the area 2 will be collectively called "a second-area scanning signal" and indicated by a symbol "Ga2", scanning signals Gmb+1 through Gmc applied to those scanning signal lines included in the area 3 will be collectively called "a third-area scanning signal" and indicated by a symbol "Ga3", and scanning signals Gmc+1 through Gm applied to those scanning signal lines included in the area 4 will be collectively called "a fourth-area scanning signal" and indicated by a symbol "Ga4". With this arrangement, the first through the fourth area scanning signals Ga1 through Ga4 are changed as follows:

As shown in FIG. 3(H), when the horizontal synchronizing signal HSY becomes active (LOW level) for the first time after a lapse of the time period T2, the first-area scanning signal Ga1 is changed from the gate ON voltage (active) to the gate OFF voltage (deactive). When the horizontal synchronizing signal HSY becomes active for the second time, the second-area scanning signal Ga2 is changed from the gate ON voltage to the gate OFF voltage. When the horizontal synchronizing signal HSY becomes active for the third time, the third-area scanning signal Ga3 is changed from the gate ON voltage to the gate OFF voltage, and when the horizontal synchronizing signal HSY becomes active for the fourth time, the fourth-area scanning signal Ga4 is changed from the gate ON voltage to the gate OFF voltage.

Thus, all of the scanning signal lines GL1-GLm which once assumed the Selected state are brought to the Deselected state in a stepwise manner, in four cycles at an interval of one horizontal scanning period, and thereafter, sequential selection of the scanning signal lines GL1-GLm, i.e. scanning, is started.

Figure 4:
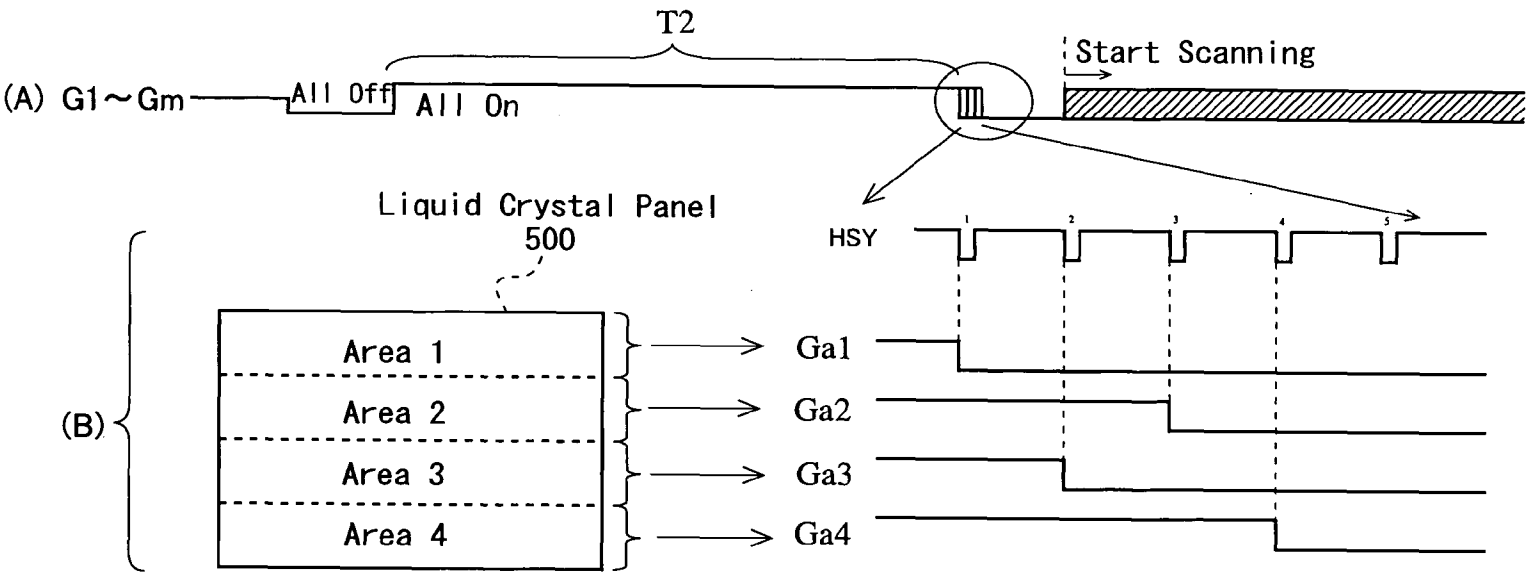
FIG. 4 shows signal waveform charts (A and B) for describing another example of Display-ON sequence according to the first embodiment.

It should be noted here that although the liquid crystal panel 500 is divided into four areas in the above description, "four" is an example, and the number of areas into which the liquid crystal panel 500 is divided into is not limited to four, provided that each of the areas includes one or more scanning signal lines. In addition, the order of the areas in which the state of scanning signal lines is changed from Selected to Deselected (namely, a sequence of areas in which the applied voltage is switched from the gate ON voltage to the gate OFF voltage) may be whatsoever as long as a plurality of the areas are not deselected simultaneously. For example, the first through the fourth area scanning signals Ga1 through Ga4 may be changed from the Selected state to the Deselected state in the order of Ga1, Ga3, Ga2 and then Ga4 as shown in FIG. 4.

<1.3 Configuration of the Scanning Signal Line Drive Circuit>

Figure 5:
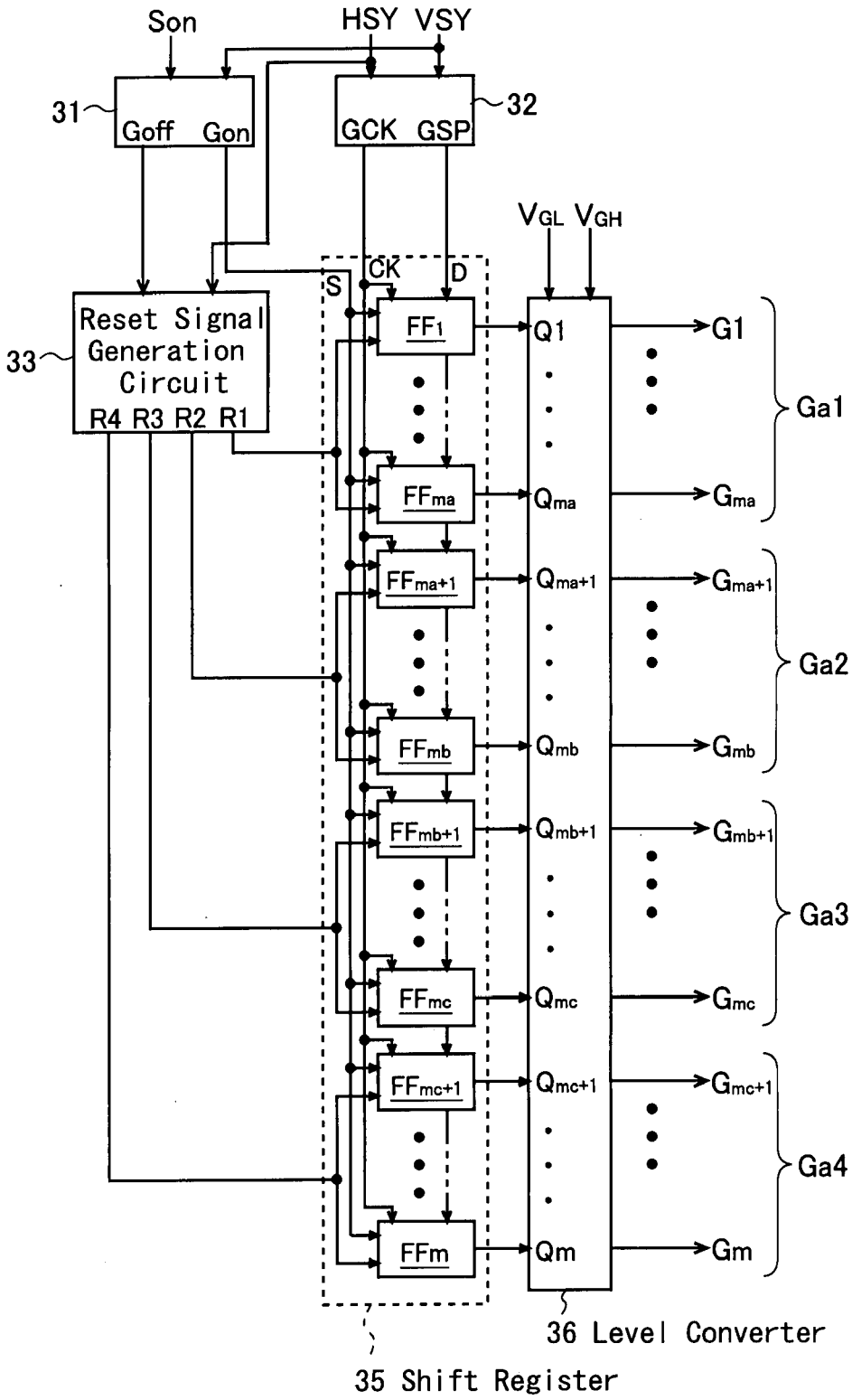
FIG. 5 is a block diagram showing an example of scanning signal line drive circuit according to the first embodiment.

Next, reference will be made to FIG. 5 to describe a configuration of the scanning signal line drive circuit 400 which deselects all of the scanning signal lines GL1-GLm once they are selected, in a stepwise manner in the Display-ON sequence as described above. FIG. 5 is a block diagram showing an example configuration of the scanning signal line drive circuit 400 according to the present embodiment. The scanning signal line drive circuit 400 according to the present configuration example includes: an m-step shift register 35 constituted by as many as m flip-flops FF1-FFm; a level converter 36 which converts an output level from each step of the shift register 35 thereby generating scanning signals G1-Gm; a first logic circuit 31 which generates a selection control signal Gon and a deselection control signal Goff from the Display-ON signal Son and the vertical synchronizing signal VSY; a second logic circuit 32 which generates a clock signal GCK and a start pulse signal GSP from the horizontal synchronizing signal HSY and the vertical synchronizing signal VSY for operation of the shift register 35; and a reset signal generation circuit 33 which generates reset signals R1-R4 from the deselection control signal Goff and the horizontal synchronizing signal HSY for resetting the flip-flops FF1-FFm in the shift register 35. As shown in FIG. 3(C), the selection control signal Gon is a signal which is active (HIGH level) during a time period T2 that is a period to select the scanning signal lines GL1-GLm in the Display-ON sequence (after the Display-ON signal Son has become HIGH level). As shown in FIG. 3(D), the deselection control signal Goff is a signal which is active (HIGH level) during a time period for a stepwise deselection of the scanning signal lines GL1-GLm that have been brought to the Selected state in the Display-ON sequence. The selection control signal Gon is inputted to each of the flip-flops FF1-FFm in the shift register 35 as a set signal. The flip-flops FF1-FFm are in a Set state (and their outputs Q1-Qm from the respective steps in the shift register 35 are HIGH level) during the time period T2 when the selection control signal Gon is active.

Under the configuration described above, the level converter 36 outputs the gate ON voltage VGH as a scanning signal Gk when the output Qk from a given step in the shift register 35 is HIGH level while outputting the gate OFF voltage VGL as a scanning signal Gk when the output Qk is LOW level (k=1 through m). Correspondingly to the first through the fourth area scanning signals Ga1 through Ga4 which are based on the zoning in the liquid crystal panel 500, the flip-flops FF1-FFm in the shift register 35 are divided into four groups, i.e. a first group of flip-flops FF1 through FFma, a second group of flip-flops FFma+1 through FFmb, a third group of flip-flops FFmb+1 through FFmc, and a fourth group of flip-flops FFmc+1 through FFm. The reset signal generation circuit 33 generates reset signals R1-R4, which are inputted to the shift register 35 as reset signals: A first reset signal R1 is inputted to the first group of flip-flops FF1 through FFma, a second reset signal R2 is inputted to the second group of flip-flops FFma+1 through FFmb, a third reset signal R3 is inputted to the third group of flip-flops FFmb+1 through FFmc, and a fourth reset signal R4 is inputted to the fourth group of flip-flops FFmc+1 through FFm.

As shown in FIGS. 3(G) through (I), the first through fourth reset signals R1-R4 change their state from deactive (LOW level) to active (HIGH level) after the time period T2 (which is a period when all of the scanning signal lines are selected) in the Display-ON sequence, sequentially when the horizontal synchronizing signal HSY becomes active (LOW level) for the first through the fourth times respectively, and thereafter, continue to be active till scanning begins (during the time when the deselection control signal Goff is active). Therefore, the first through the fourth groups of flip-flops FF1 through FFma, FFma+1 through FFmb, FFmb+1 through FFmc, and FFmc+1 through FFm in the shift register 35 are reset sequentially by the first through the fourth reset signals R1-R4, whereby the voltage in the first through the fourth area scanning signals Ga1 through Ga4 change as shown in FIG. 3(H), from the gate ON voltage to the gate OFF voltage, sequentially at an interval of one horizontal scanning period. Thus, the scanning signal lines GL1-GLm in the liquid crystal panel 500 change their state from Selected to Deselected in gradual steps of four.

As described above, the first logic circuit 31 generates the selection control signal Gon, which sets each of the flip-flops FF1-FFm to select all of the scanning signal lines GL1-GLm. Thereafter, based on the deselection control signal Goff generated by the first logic circuit 31, the reset signal generation circuit 33 generates the first through the fourth reset signals R1-R4, which reset the flip-flops FF1-FFm in a stepwise manner, to deselect the scanning signal lines GL1-GLm in a stepwise manner. Therefore, in the present configuration, the first logic circuit 31 and the m flip-flops FF1-FFm function as a selection-making section which brings the scanning signal lines GL1-GLm into the Selected state whereas the first logic circuit 31, the reset signal generation circuit 33 and the m flip-flops FF1-FFm function as a selection-canceling section which brings the selected scanning signal lines GL1-GLm into the Deselected state in a stepwise manner.

It should be noted here that the scanning signal line drive circuit 400 in the present embodiment is not limited to those having a configuration shown in FIG. 5, but may be configured in any way as long as it is capable of generating scanning signals such as the first through the fourth area scanning signals Ga1-Ga4 shown in FIG. 3(H) or FIG. 4(B) in the Display-ON sequence, for first selecting the scanning signal lines GL1-GLm in the liquid crystal panel 500, and then deselecting them in a stepwise manner.

<1.4 Advantages>

According to the present embodiment as described above, during a Display-ON sequence when a liquid crystal display device is started, all scanning signal lines GL1-GLm in a liquid crystal panel 500 are selected once, to release electric charges which are accumulated at a liquid crystal capacity Clc and a supplementary capacity Cs in each pixel formation portions Px, and thereafter, the scanning signal lines GL1-GLm are deselected in a stepwise manner in a plurality of times (four times in the example in FIG. 3, etc). Thus, unlike in conventional art where the scanning signal lines GL1-GLm in the liquid crystal panel 500 are brought simultaneously to the Deselected state, the number of scanning signal lines in which the applied voltage changes from the gate ON voltage to the gate OFF voltage simultaneously is remarkably smaller. This eliminates chances for an excessive current to pass through the bulk (silicon substrate) which constitutes the scanning signal line drive circuit 400. Therefore, it becomes possible to control power source electric potential fluctuation caused by a current which flows through the bulk in the scanning signal line drive circuit 400 when deselecting the scanning signal lines GL1-GLm, and to prevent malfunctions of the scanning signal line drive circuit 400 caused by latch-ups for example.

In the above-described embodiment, the scanning signal lines GL1-GLm in the liquid crystal panel 500 are divided into four scanning signal line groups, and in accordance with this grouping, the scanning signal lines GL1-GLm are brought to the Deselected state in a stepwise manner, in four cycles of operations. Increasing the number of groups will increase the above-described advantage of preventing malfunctions. However, too many groups will increase complication in the configuration of the selection-canceling section necessary for the stepwise deselection of the scanning signal lines GL1-GLm. Therefore, the number of groups should be selected appropriately through consideration into both the advantage and the configuration. This applies also to other embodiments to be described hereinafter. In the above-described embodiment, a supplementary capacity Cs is formed by a pixel electrode Ep and a supplementary electrode Es, in each pixel formation portion Px in the liquid crystal panel 500; however, there is no need for the configuration to include the supplementary electrode Es, or the supplementary capacity Cs to be formed. This also applies to the other embodiments to be described hereinafter.

2. Second Embodiment

Next, a liquid crystal display device according to a second embodiment of the present invention will be described. The liquid crystal display device has essentially the same overall configuration as of the first embodiment, but uses a different operational method and scanning signal line drive circuit configuration therefor for deselecting the scanning signal lines which are once selected, in the Display-ON sequence. Hereinafter, description will focus mainly on these differences from the first embodiment. It should be noted that those components and elements in the liquid crystal display device in the second embodiment which are identical with or corresponding to those in the first embodiment will be indicated by the same alphanumerical symbols.

<2.1 Display-ON Sequence>

Figure 6:
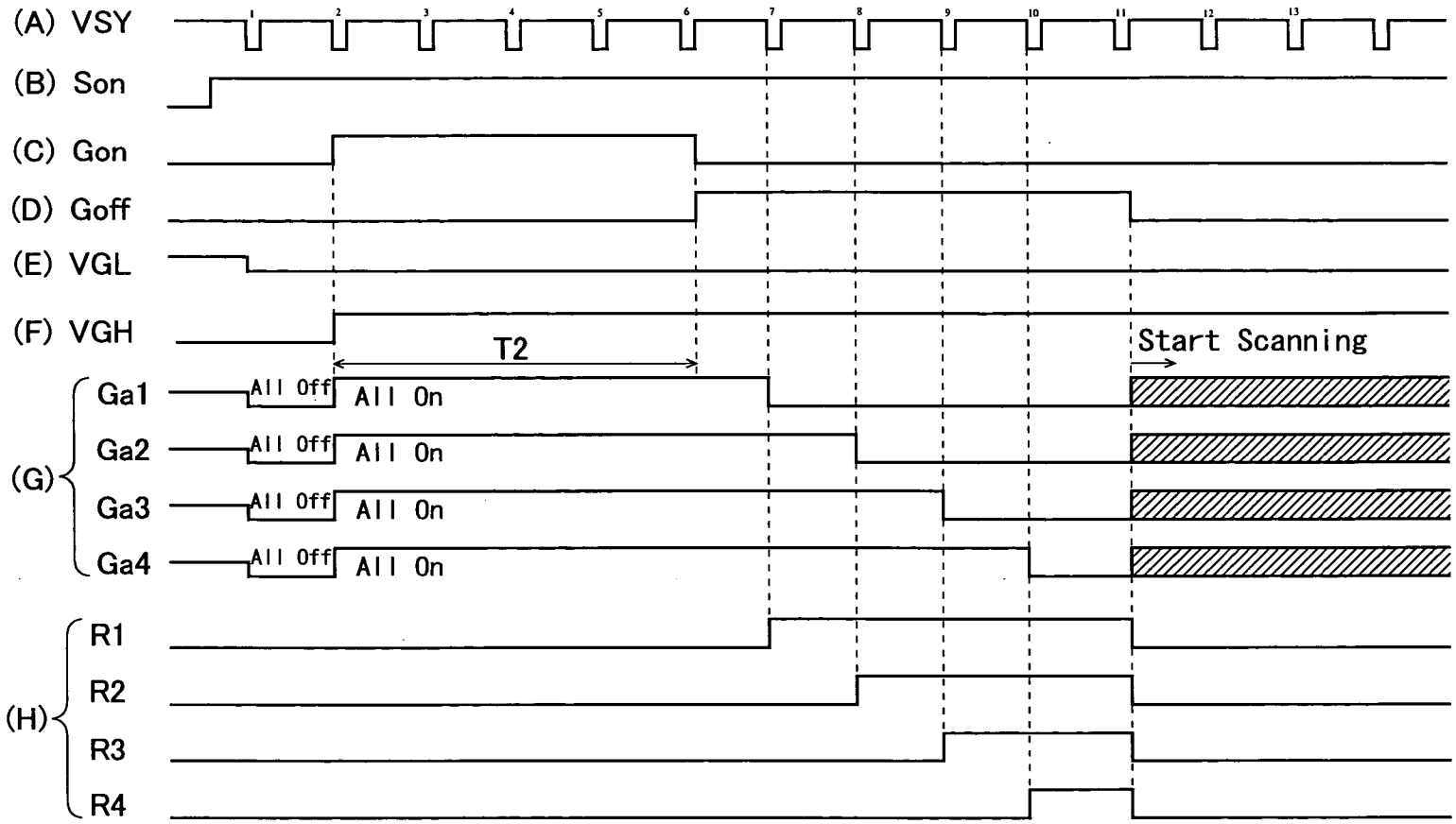
FIG. 6 shows signal waveform charts (A through H) for describing an example of Display-ON sequence according to a second embodiment of the present invention.

FIG. 6 shows waveform charts of the vertical synchronizing signal VSY, the gate OFF voltage VGL, the gate ON voltage VGH, the scanning signals (including the first-area through the fourth-area scanning signals Ga1-Ga4), etc. right after the liquid crystal display device is started. Again in the present embodiment, all scanning signal lines GL1-GLm in the liquid crystal panel 500 are selected once during a Display-ON sequence, to release electric charges which are accumulated at the liquid crystal capacity Clc and the supplementary capacity Cs in each pixel formation portion Px, and thereafter, the scanning signal lines are deselected in a plurality of cycles in a stepwise manner.

Again in the present embodiment, the liquid crystal panel 500 is divided into four areas as shown in FIG. 3(H), to area 1 through area 4, and based on this grouping, the scanning signal lines are deselected in a stepwise manner, in four cycles of operations as shown in FIG. 6(G). However, unlike in the first embodiment where the deselecting cycle is performed at an interval of one horizontal scanning period, in the present embodiment the deselecting cycle is performed at an interval of one vertical scanning period (one frame period). Specifically, with the first through the fourth area scanning signal Ga1-Ga4 being defined in the same way as in the first embodiment, according to the present embodiment, all of the scanning signal lines GL1-GLm in the liquid crystal panel 500 are selected for a time period T2 which is equivalent to several frame periods, and thereafter, the first through the fourth area scanning signals Ga1 through Ga4 are changed as follows:

When the vertical synchronizing signal VSY becomes active (LOW level) for the first time after a lapse of the time period T2 during which all of the scanning signal lines GL1-GLm are selected, the first-area scanning signal Ga1 is changed from the gate ON voltage (active) to the gate OFF voltage (deactive). When the vertical synchronizing signal VSY becomes active for the second time, the second-area scanning signal Ga2 is changed from the gate ON voltage to the gate OFF voltage. When the vertical synchronizing signal VSY becomes active for the third time, the third-area scanning signal Ga3 is changed from the gate ON voltage to the gate OFF voltage, and when the vertical synchronizing signal VSY becomes active for the fourth time, the fourth-area scanning signal Ga4 is changed from the gate ON voltage to the gate OFF voltage.

Thus, all of the scanning signal lines GL1-GLm which once assumed Selected state are brought to Deselected state in four cycles in gradual steps at an interval of one vertical scanning period, and thereafter, sequential selection of the scanning signal lines GL1-GLm, i.e. scanning is started.

It should be noted here that although the liquid crystal panel 500 is divided into four areas in the above description, "four" is an example as in the first embodiment, and the number of areas into which the liquid crystal panel 500 is divided is not limited to four, provided that each of the areas includes one or more scanning signal lines. In addition, the order of the areas in which the state of scanning signal lines is changed from Selected to Deselected (namely, a sequence of areas in which the applied voltage is switched from the gate ON voltage to the gate OFF voltage) may be whatsoever as long as a plurality of the areas are not deselected simultaneously.

<2.2 Configuration of the Scanning Signal Line Drive Circuit>

Figure 7:
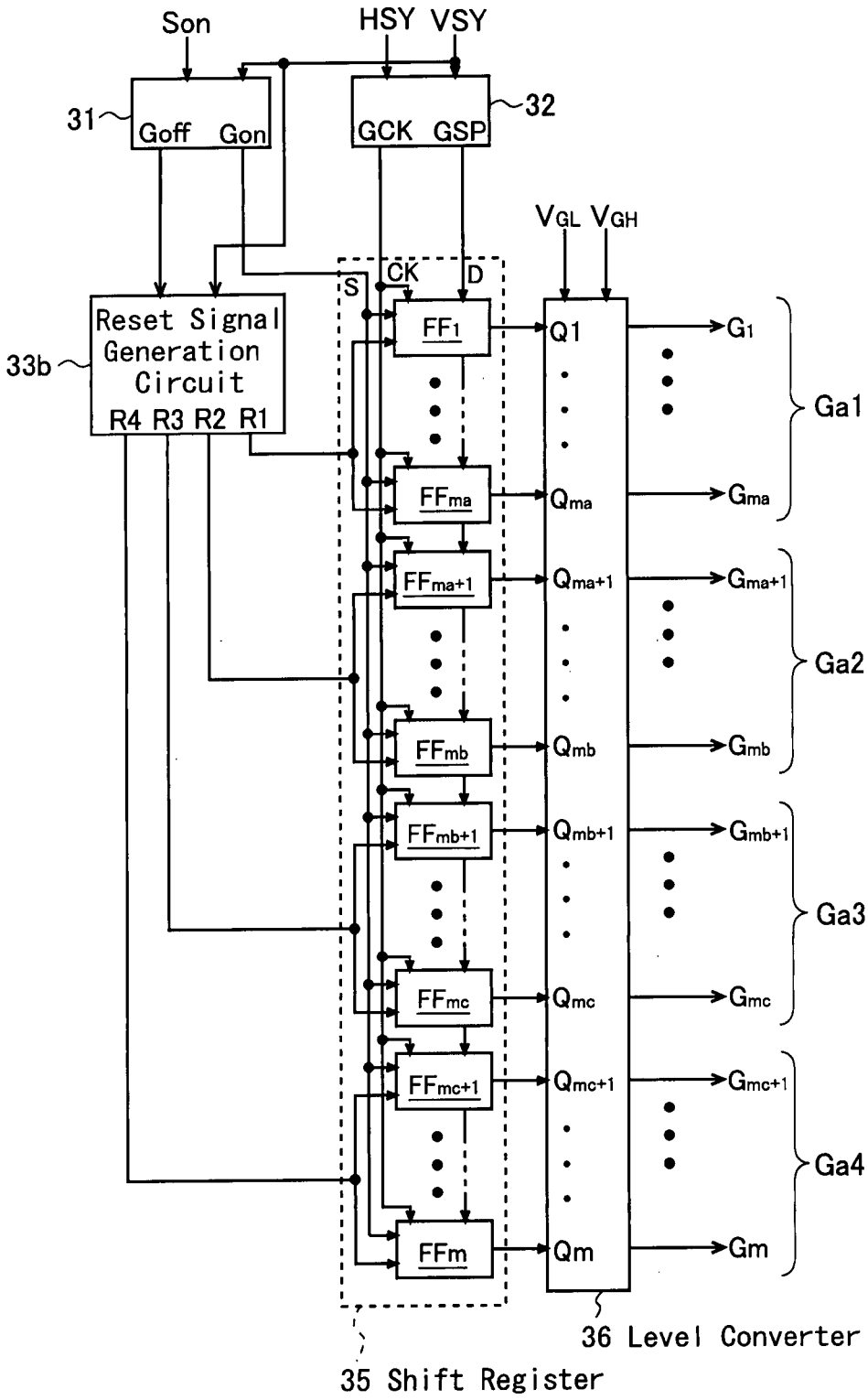
FIG. 7 is a block diagram showing an example of scanning signal line drive circuit according to the second embodiment.

FIG. 7 is a block diagram showing an example configuration of the scanning signal line drive circuit 400 according to the present embodiment. The scanning signal line drive circuit 400 according to the present configuration differs from the one in FIG. 5 where reset signals R1-R4 are generated from the deselection control signal Goff and the horizontal synchronizing signal HSY; in order to achieve the stepwise deselection of the scanning signal lines GL1-GLm at an interval of one vertical scanning period, a reset signal generation circuit 33*b* generates the reset signals R1-R4 from the deselection control signal Goff and the vertical synchronizing signal VSY. Other aspects of the configuration in FIG. 7 are the same as in FIG. 5, thus identical or corresponding components and elements are indicated by the same alphanumerical symbols, and no more description will be made here.

As shown in FIG. 6(H), the first through the fourth reset signals R1-R4 change their state from deactive (LOW level) to active (HIGH level) after the time period T2 in the Display-ON sequence, sequentially when the vertical synchronizing signal VSY becomes active (LOW level) for the first through the fourth times respectively, and thereafter, continue to be active till scanning begins (during the time when deselection control signal Goff is active). Therefore, as shown in FIG. 6(D), the deselection control signal Goff is generated as a signal which assumes the active state (HIGH level) for a period longer than four vertical scanning periods after the lapse of the time period T2. The first through the fourth groups of flip-flops FF1 through FFma, FFma+1 through FFmb, FFmb+1 through FFmc, and FFmc+1 through FFm in the shift register 35 are reset sequentially by the first through the fourth reset signals R1-R4 as described, whereby the voltage in the first through the fourth area scanning signals Ga1 through Ga4 change as shown in FIG. 6(G), from the gate ON voltage to the gate OFF voltage, sequentially at an interval of one vertical scanning period. Thus, the scanning signal lines GL1-GLm in the liquid crystal panel 500 change their state from Selected to Deselected in gradual steps of four.

It should be noted here that the scanning signal line drive circuit 400 in the present embodiment is not limited to those having a configuration shown in FIG. 7, but may be configured in any way as long as it is capable of generating scanning signals such as the first through the fourth area scanning signals Ga1-Ga4 shown in FIG. 6(G) in the Display-ON sequence, for first selecting the scanning signal lines in the liquid crystal panel 500 and then deselecting them in a stepwise manner.

<2.3 Advantages>

According to the present embodiment as described above, like in the first embodiment, during a Display-ON sequence when a liquid crystal display device is started, all scanning signal lines GL1-GLm in a liquid crystal panel 500 are selected once, to release electric charges which are accumulated at liquid crystal capacities Clc and supplementary capacities Cs in pixel formation portions Px, and thereafter, the scanning signal lines GL1-GLm are deselected in a stepwise manner in a plurality of times (four times in the example in FIG. 6). Thus, unlike in conventional art where the scanning signal lines in the liquid crystal panel 500 are brought simultaneously to the Deselected state, the number of scanning signal lines in which the applied voltage changes from the gate ON voltage to the gate OFF voltage simultaneously is remarkably smaller. This eliminates chances for an excessive current to pass through the bulk in the scanning signal line drive circuit 400. Therefore, it becomes possible to control power source electric potential fluctuation caused by a current which flows through the bulk in the scanning signal line drive circuit 400 when deselecting the scanning signal lines GL1-GLm, and to prevent malfunctions of the scanning signal line drive circuit 400 caused by latch-ups for example.

In the present embodiment, the Display-ON sequence will be simpler than in the first embodiment although the sequence will take a longer time since a vertical scanning period is used as an interval for stepwise deselection of all the scanning signal lines. Therefore, the first embodiment is preferred if a quicker start of display has a priority. According to the present embodiment, however, the selection-canceling section for stepwise deselection of the scanning signal lines can be implemented more easily than in the first embodiment.

3. Third Embodiment

In the first and the second embodiments, the scanning signal line drive circuit 400 has a configuration shown in FIG. 5 or FIG. 7, where the flip-flops in the shift register 35 are reset in a stepwise manner by the reset signals R1-R4 in order to deselect the scanning signal lines, which have been brought to Selected state, in the Display-ON sequence. In place of this arrangement, stepwise deselection of the scanning signal lines may be achieved by changing a start pulse signal which is to be inputted to the shift register. Hereinafter, description will cover a third embodiment which includes a liquid crystal display device provided with such a scanning signal line drive circuit. Note that all of the aspects other than the scanning signal line drive circuit are identical with those in the first embodiment, so identical or corresponding components and elements are indicated by the same alphanumerical symbols, and no more description will be made here.

Figure 8:
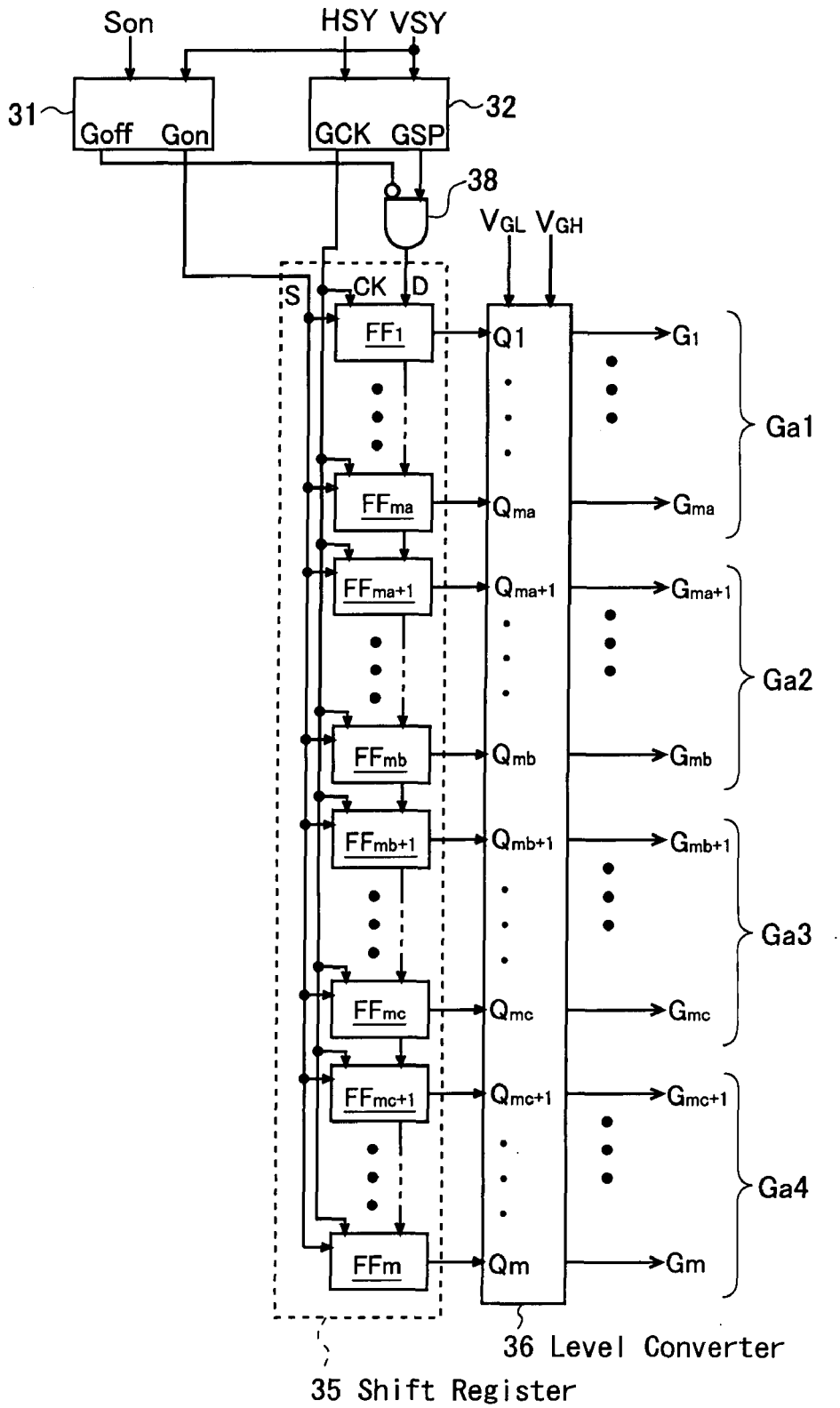
FIG. 8 is a block diagram showing an example of scanning signal line drive circuit according to a third embodiment of the present invention.

FIG. 8 is a block diagram showing an example configuration of the scanning signal line drive circuit according to the present embodiment. Like the configurations shown in FIG. 5 and FIG. 7, a scanning signal line drive circuit 400 according to the present configuration example includes: an m-step shift register 35 constituted by as many as m flip-flops FF1-FFm; a level converter 36 which converts an output level from each step of the shift register 35 thereby generating scanning signals G1-Gm; a first logic circuit 31 which generates a selection control signal Gon and a deselection control signal Goff from the Display-ON signal Son and the vertical synchronizing signal VSY; and a second logic circuit 32 which generates a clock signal GCK and a start pulse signal GSP from the horizontal synchronizing signal HSY and the vertical synchronizing signal VSY for operation of the shift register 35; but does not include a reset signal generation circuit; and instead, includes an AND gate 38 which generates a logical product signal of the logically inverted deselection control signal Goff and a start pulse signal GSP.

The deselection control signal Goff becomes active during a time period for stepwise deselection of the scanning signal lines which have been selected in the Display-ON sequence. In this example, the signal becomes active (HIGH level) for a period of one vertical scanning period. Therefore, an output signal from the AND gate 38 which is inputted to the shift register 35 as the start pulse signal, assumes LOW level during this period, and as a result, those outputs Q1-Qm from the shift register 35 change sequentially from HIGH level to LOW level based on the clock signal GCK which has a pulse period of one horizontal scanning period. In response to this, the scanning signals G1-Gm change sequentially from the gate ON voltage to the gate OFF voltage, and as a result, the scanning signal lines GL1-GLm in the liquid crystal panel 500 become deselected sequentially, one after another in the vertical scanning period, at an interval of one horizontal scanning period.

Deselecting the scanning signal lines in the liquid crystal panel 500 in this way, sequentially one by one in the Display-ON sequence, enables to provide the same advantage as offered by the first and the second embodiments, without generating reset signals for the shift register 35 in the scanning signal line drive circuit 400.

4. Fourth Embodiment

In the first and the second embodiments, scanning signal lines GL1-GLm in the liquid crystal panel 500 are selected once, and then the scanning signal lines GL1-GLm are not deselected simultaneously but deselected in a stepwise manner before starting sequential scanning for display, i.e. before starting scanning, in the Display-ON sequence, thereby decreasing power source electric potential fluctuation caused by a current which flows through the bulk (silicon substrate) that constitutes the scanning signal line drive circuit 400. However, as shown in FIG. 3, FIG. 4, and FIG. 6, the scanning signal lines GL1-GLm in the liquid crystal panel 500 are brought from the Deselected state to the Selected sate simultaneously right after the beginning of Display-ON sequence. The time when the scanning signal lines GL1-GLm are selected simultaneously in the Display-ON sequence in this way is another time of risk that an excessive current can flow through the bulk (silicon substrate) that constitutes the scanning signal line drive circuit 400, leading to a malfunction of the scanning signal line drive circuit. Therefore, it is preferable to configure the selection-making section so as to select the scanning signal lines GL1-GLm in a stepwise manner, in order to prevent malfunction caused by a power electric potential fluctuation at the time when the scanning signal lines GL1-GLm are selected during the Display-ON sequence. Hereinafter, description will cover a fourth embodiment which includes a scanning signal line drive circuit that has such a selection-making section. Note that all of the aspects other than the scanning signal line drive circuit are identical with those in the first embodiment, so identical or corresponding components and elements are indicated by the same alphanumerical symbols, and no more description will be made here.

Figure 9:
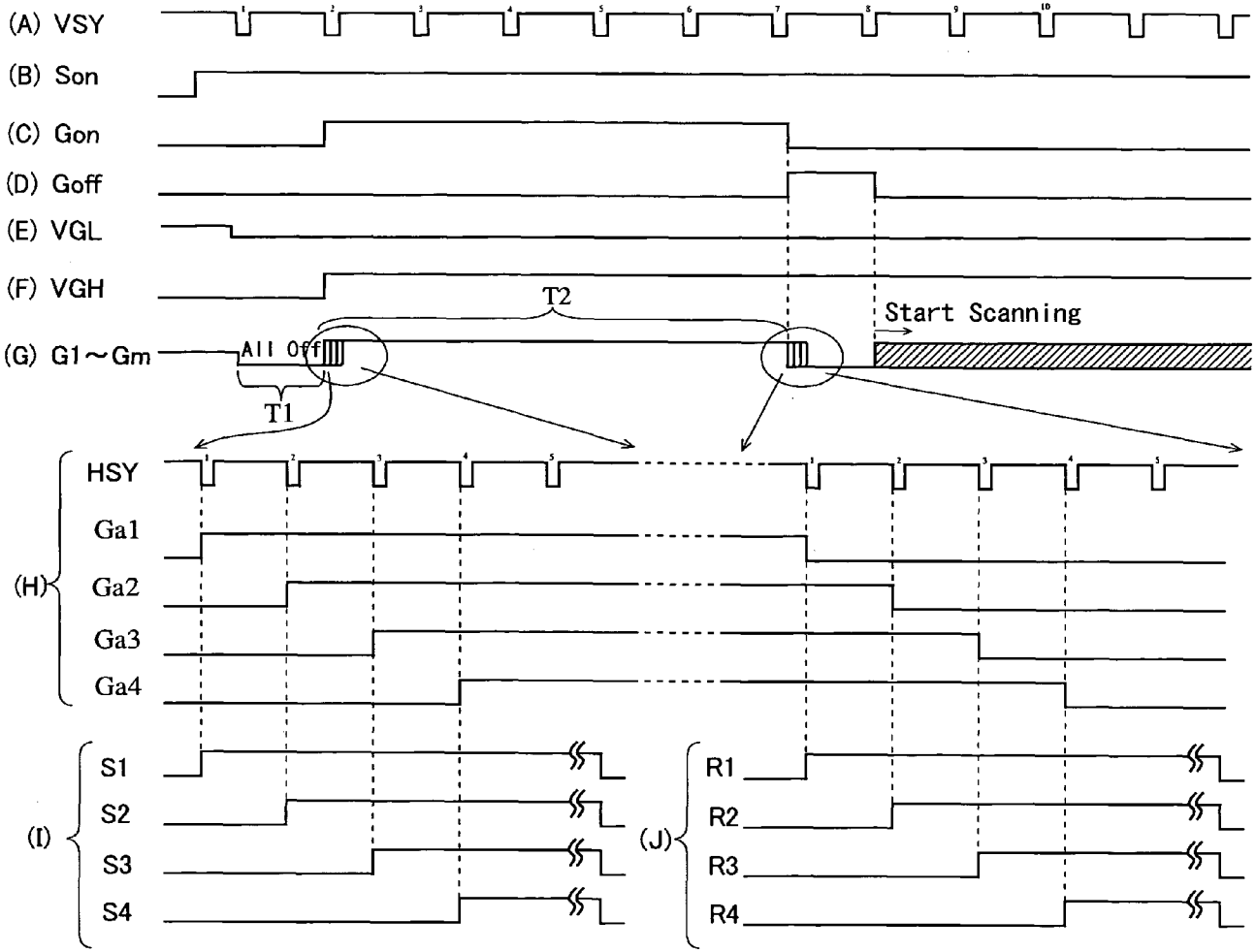
FIG. 9 shows signal waveform charts (A through J) for describing an example of Display-ON sequence according to a fourth embodiment of the present invention.

In the first embodiment for example, as shown in FIG. 3, the scanning signal lines GL1-GLm are deselected in four cycles of operation at an interval of one horizontal scanning period, during the period when the deselection control signal Goff stays active (HIGH level). In addition to this, there may be an arrangement as shown in FIG. 9, where the scanning signal lines GL1-GLm are brought from the Deselected state to the Selected state in four cycles of operation at an interval of one horizontal scanning period when the selection control signal Gon becomes active (HIGH level).

Figure 10:
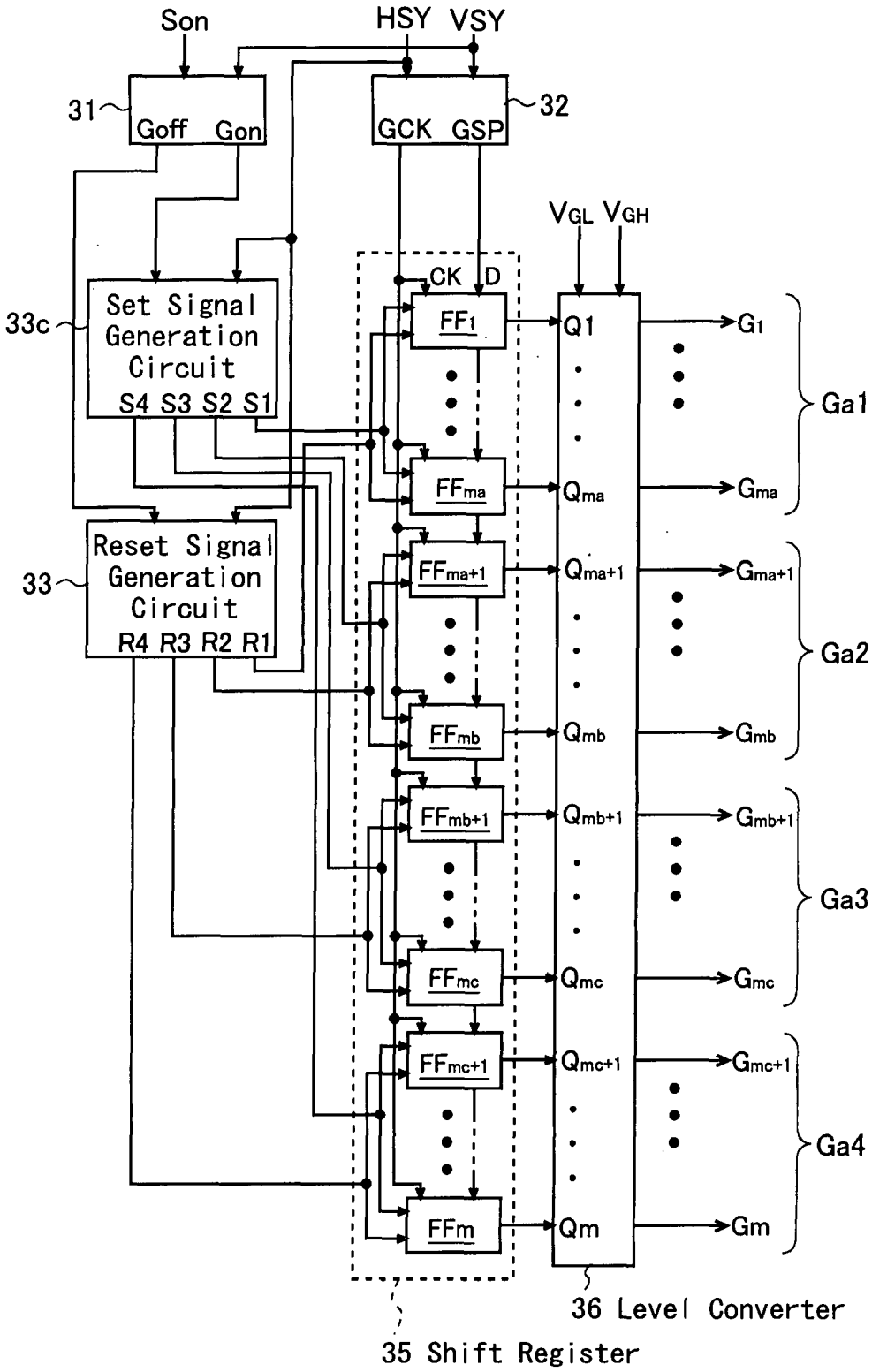
FIG. 10 is a block diagram showing an example of scanning signal line drive circuit according to the fourth embodiment.
Figure 11:
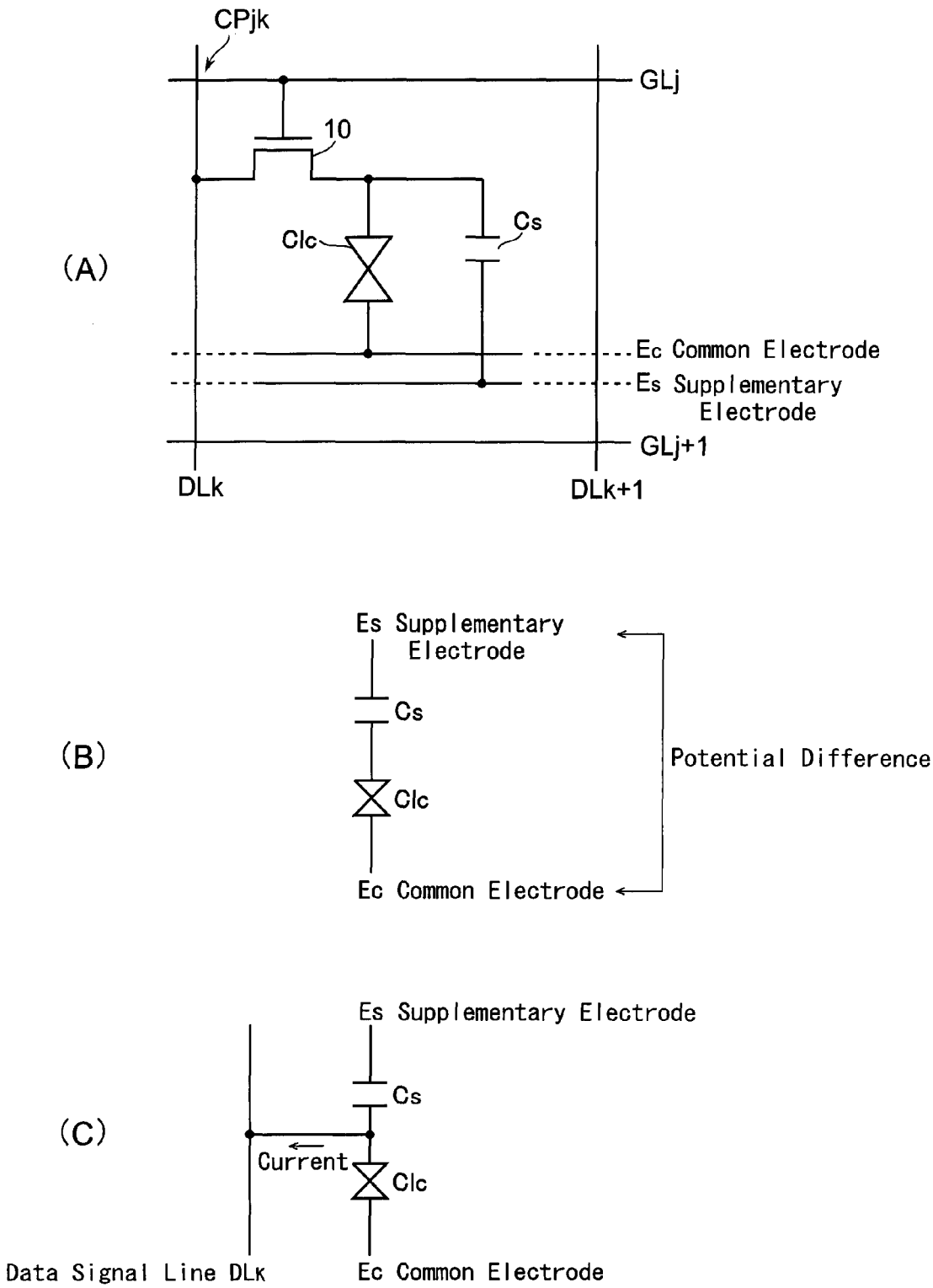
FIG. 11 shows circuit diagrams (A through C) for describing a problem in display at a start up of a liquid crystal display device.
Figure 12:
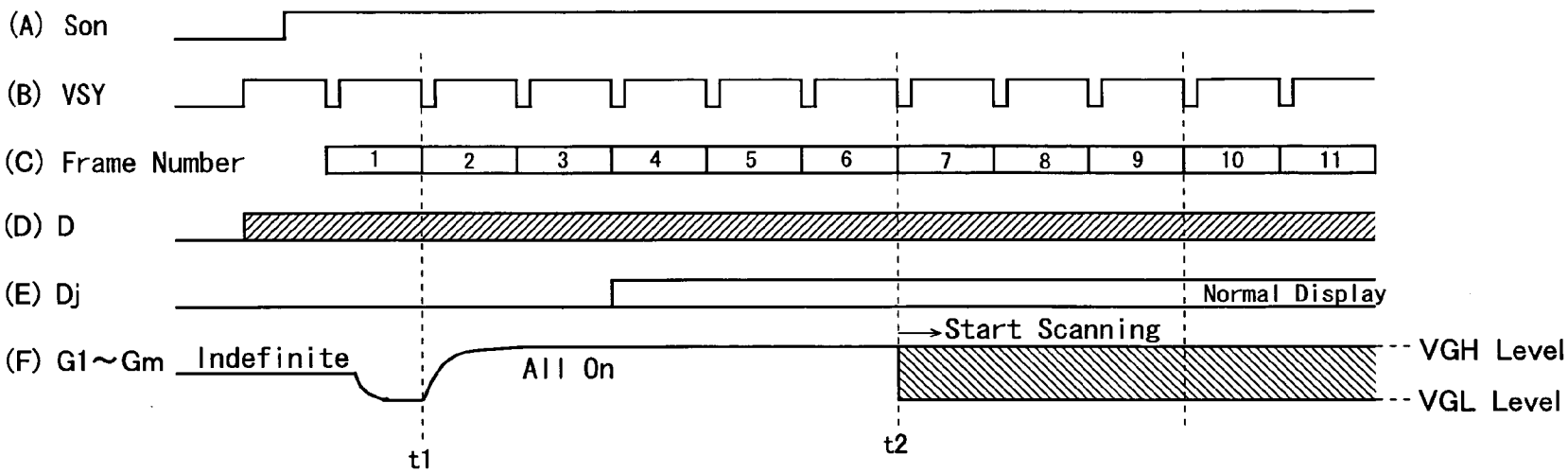
FIG. 12 shows signal waveform charts (A through F) for describing a conventional Display-ON sequence in a liquid crystal display device.

FIG. 10 shows an example configuration of a scanning signal line drive circuit according to the present embodiment which performs such an operation in the Display-ON sequence. The scanning signal line drive circuit according to the present configuration includes not only the reset signal generation circuit 33 which generates the first through the fourth reset signals R1-R4 (FIG. 9(J)) but also a set signal generation circuit 33*c* which generates a first through a fourth set signals S1-S4 for stepwise setting of the flip-flops which constitute the shift register in the scanning signal line drive circuit. All the other aspects are identical with the scanning signal line drive circuit in FIG. 5, so identical components and elements are indicated by the same alphanumerical symbols, and no more description will be made here.

In this configuration example, a set signal inputted to each of the flip-flops FF1-FFm in the shift register 35 is not the selection control signal Gon: Of all the flip-flops FF1-FFm, the first group of flip-flops FF1 through FFma is supplied with the first set signal S1, the second group of flip-flops FFma+1 through FFmb are supplied with the second set signal S2, the third group of flip-flops FFmb+1 through FFmc are supplied with the third set signal S3, and the fourth group of flip-flops FFmc+1 through FFm are supplied with the fourth set signal S4. The set signal generation circuit 33*c* generates a set of signals as shown in FIG. 9(I) as these first through fourth set signals S1 through S4, which become active sequentially at an interval of one horizontal scanning period. Specifically, the first through the fourth set signals S1-S4 change their state from deactive (LOW level) to active (HIGH level) when the horizontal synchronizing signal HSY becomes active (LOW level) for the first time through the fourth time respectively, after the Display-ON sequence has started, all of the scanning signal lines GL1-GLm has become deselected (gate OFF voltage VGL), and the selection control signal Gon has become active (HIGH level) Thereafter, these set signals S1-S4 continue to be active as long as the selection control signal Gon is active, and then become deactive when the selection control signal Gon becomes deactive. The first through the fourth groups of flip-flops FF1 through FFma, FFma+1 through FFmb, FFmb+1 through FFmc, and FFmc+1 through FFm in the shift register 35 are set sequentially by the first through the fourth set signals S1-S4 as described, whereby the voltage in the first through the fourth area scanning signals Ga1-Ga4 (See FIG. 3) change as shown in FIG. 9(H), from the gate OFF voltage to the gate ON voltage, sequentially at an interval of one horizontal scanning period. Thus, the scanning signal lines GL1-GLm in the liquid crystal panel 500 change their state from Deselected to Selected in gradual steps of four.

Therefore, according to the liquid crystal display device which includes the scanning signal line drive circuit of the above-described configuration, unlike in conventional art where the scanning signal lines GL1-GLm in the liquid crystal panel 500 are brought simultaneously to the Selected state, the number of scanning signal lines in which the applied voltage changes from the gate OFF voltage to the gate ON voltage simultaneously is remarkably smaller. This eliminates chances for an excessive current to pass through the bulk (silicon substrate) which constitutes the scanning signal line drive circuit 400. Therefore, power source electric potential fluctuation caused by a current which flows through the bulk in the scanning signal line drive circuit 400 is reduced not only when deselecting but also when selecting the scanning signal lines GL1-GLm in the Display-ON sequence, enabling more assuredly to prevent malfunctions of the scanning signal line drive circuit 400 caused by latch-ups for example.

It should be noted here that although the above-described configuration uses an arrangement that scanning signal lines GL1-GLm in the liquid crystal panel 500 are divided into four groups and selection is made for one group (by the area) at a time, "four" is an example, and the number of areas into which the liquid crystal panel 500 is divided is not limited to four, provided that each of the areas includes one or more scanning signal lines. In addition, the order of the areas in which the state of scanning signal lines is changed from Deselected to Selected (a sequence of areas in which the applied voltage is switched from the gate OFF voltage to the gate ON voltage) may be whatsoever as long as a plurality of the areas are not selected simultaneously. Further, in the above-described configuration, the scanning signal lines GL1-GLm are selected in a stepwise manner at an interval of one horizontal scanning period; however, the interval is not limited either. For example, the scanning signal lines GL1-GLm may be selected in a stepwise manner at an interval of one vertical scanning period (one frame period)

The invention claimed is:

1. A drive circuit for an active matrix liquid crystal display device including: a plurality of data signal lines; a plurality of scanning signal lines crossing with the data signal lines; and a plurality of pixel formation portions disposed in a matrix pattern each corresponding to one of intersections made by the data signal lines and the plurality of scanning signal lines; each pixel formation portion including a capacity for taking and holding a voltage of a data signal line which passes through the corresponding intersection when the selection is made to the scanning signal line that passes through the intersection; the drive circuit applying to the data signal lines a plurality of data signals representing an image to be displayed, while making sequential selection of the plurality of scanning signal lines for formation of the image to be displayed in the pixel formation portions;

the drive circuit comprising:

a selection-making section configured to select the plurality of scanning signal lines simultaneously upon reception of a signal indicating a commencement of display in the liquid crystal display device, and before any formation of images on the plurality of pixel formation portions occurring after the signal is received;

a discharging section configured to discharge electric charges accumulated at the capacities in the pixel formation portions via the data signal lines while the plurality of scanning signal lines are selected by the selection-making section, and before any formation of images on the plurality of pixel information portions occurring after the signal is received; and a selection-canceling section configured to deselect the plurality of scanning signal lines which have been simultaneously selected by the selection-making section, in a stepwise manner after the discharge of the accumulated electric charges by the discharging section, before any formation of images on the plurality of pixel information portions occurring after the signal is received, and before a commencement of sequential selection of the plurality of scanning signal lines for forming images on the plurality of pixel formation portions.

2. The drive circuit according to claim 1, wherein the selection-canceling section deselects a plurality of scanning signal line groups created by grouping the plurality of scanning signal lines, one group at a time, in the stepwise manner.

3. The drive circuit according to claim 1, wherein the selection-canceling section deselects the plurality of scanning signal lines in a plurality of cycles at an interval of one horizontal scanning period for the display in the liquid crystal display device, in the stepwise manner.

4. The drive circuit according to claim 1, wherein the selection-canceling section deselects the plurality of scanning signal lines in a plurality of cycles at an interval of one vertical scanning period for the display in the liquid crystal display device, in the stepwise manner.

5. The drive circuit according to claim 1, wherein the selection-making section selects the plurality of scanning signal lines in a stepwise manner.

6. The drive circuit according to claim 5, wherein the selection-making section selects a plurality of scanning signal line groups created by grouping the plurality of scanning signal lines, one group at a time in the stepwise manner.

7. A liquid crystal display device comprising the drive circuit according to claim 5.

8. A liquid crystal display device comprising the derive circuit according to claim 1.

9. The drive circuit of claim 1, wherein the selection-making section is further configured to select the plurality of scanning signal lines upon reception of a signal indicating a commencement of an initial display after powering on in the liquid crystal display device, and before any formation of images on the plurality of pixel formation portions occurring after the signal is received.

10. A drive method for an active matrix liquid crystal display device including: a plurality of data signal lines; a plurality of scanning signal lines crossing with the data signal lines; and a plurality of pixel formation portions disposed in a matrix pattern each corresponding to one of intersections made by the data signal lines and the plurality of scanning signal lines; each pixel formation portion including a capacity for taking and holding a voltage of a data signal line which passes through the corresponding intersection when the selection is made to the scanning signal line which passes through the intersection; by applying to the data signal lines a plurality of data signals representing an image to be displayed while making sequential selection of the plurality of scanning signal lines for formation of the image to be displayed in the pixel formation portions;

the method comprising:

a selection-making step of selecting the plurality of scanning signal lines simultaneously upon reception of a signal indicating a commencement of display in the liquid crystal display device, and before any formation of images on the plurality of pixel formation portions occurring after the signal is received;

a discharging step of discharging electric charges accumulated at the capacities in the pixel formation portions via the data signal lines while the plurality of scanning signal lines are selected in the selection-making step, and before any formation of images on the plurality of pixel formation portions occurring after the signal is received; and a selection-canceling step of deselecting the plurality of scanning signal lines which have been selected simultaneously in the selection-making step, in a stepwise manner after the discharge of the accumulated electric charges in the discharging step, before any formation of images on the plurality of pixel formation portions occurring after the signal is received, and before a commencement of sequential selection of the plurality of scanning signal lines for forming images on the plurality of pixel formation portions.

11. The drive method according claim 10, wherein a plurality of scanning signal line groups created by grouping the plurality of scanning signal lines are deselected, one group at a time in a stepwise manner, in the selection-canceling step.

12. The drive method according claim 10, wherein the plurality of scanning signal lines are selected in a stepwise manner, in the selection-making step.

13. The drive method according claim 12, wherein a plurality of scanning signal line groups created by grouping the plurality of scanning signal lines are selected, one group at a time in a stepwise manner, in the selection-making step.

14. The drive method of claim 10, wherein the selection-making step further includes selecting the plurality of scanning signal lines upon reception of a signal indicating a commencement of an initial display after powering on in the liquid crystal display device, and before any formation of images on the plurality of pixel formation portions occurring after the signal is received.

* * * * *

UNITED STATES PATENT AND TRADEMARK OFFICE

CERTIFICATE OF CORRECTION

PATENT NO. : 8,120,563 B2
APPLICATION NO. : 11/883625
DATED : February 21, 2012
INVENTOR(S) : Kozo Takahashi It is certified that error appears in the above-identified patent and that said Letters Patent is hereby corrected as shown below:

On the Title Page, Item (86) should read,

(86) PCT No.: PCT/JP2006/302171

Signed and Sealed this
Eighth Day of May, 2012

David J. Kappos

David J. Kappos
*Director of the United States Patent and Trademark Office*